US011104539B1

(12) United States Patent
Sugizaki

(10) Patent No.: US 11,104,539 B1
(45) Date of Patent: Aug. 31, 2021

(54) POSTPROCESSING APPARATUS AND IMAGE PROCESSING SYSTEM

(71) Applicant: TOSHIBA TEC KABUSHIKI KAISHA, Tokyo (JP)

(72) Inventor: Yoshiaki Sugizaki, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/986,927

(22) Filed: Aug. 6, 2020

(51) Int. Cl.
*B65H 9/10* (2006.01)
*B65H 43/00* (2006.01)
*B65H 37/04* (2006.01)

(52) U.S. Cl.
CPC ..... *B65H 43/00* (2013.01); *B65H 37/04* (2013.01)

(58) Field of Classification Search
CPC ... B65H 9/04; B65H 9/06; B65H 9/10; B65H 9/101; B65H 34/26; B65H 34/34; B65H 2301/3613; B65H 2301/3621; B65H 2408/114
USPC ..... 270/58.11, 58.12, 58.16, 58.17, 58.27
See application file for complete search history.

(56) References Cited

U.S. PATENT DOCUMENTS 7,413,178 B2 * 8/2008 Fujii ..... B65H 29/51 270/58.01
7,448,615 B2 * 11/2008 Takamura ..... B42C 1/12 270/58.11
7,690,638 B2 * 4/2010 Kikuchi ..... B65H 33/08 270/58.16
7,913,990 B2 * 3/2011 Nakamura ..... G03G 15/6547 270/58.11
8,070,150 B2 * 12/2011 Tanaka ..... B65H 31/10 270/58.27

FOREIGN PATENT DOCUMENTS

JP 2006-008370 A 1/2006

* cited by examiner

*Primary Examiner* — Leslie A Nicholson, III
(74) *Attorney, Agent, or Firm* — Foley & Lardner LLP

(57) ABSTRACT

A postprocessing apparatus includes a horizontal alignment plate, a binder, a tray, and a shift actuator assembly. The horizontal alignment plate is positioned to align sheets in a sheet width direction. The binder binds sheets to form bound sheet bundles. The bound sheet bundles are stacked on the tray. The shift actuator assembly shifts the bound sheet bundles in the sheet width direction. A postprocessing controller controls the shift actuator assembly to shift the bound sheet bundles such that swollen portions of the bound sheet bundles are shifted inward of the horizontal alignment plate in the sheet width direction when the processed sheets are piled on the tray to the vicinity of the horizontal alignment plate.

13 Claims, 10 Drawing Sheets

POSTPROCESSING APPARATUS AND IMAGE PROCESSING SYSTEM

FIELD

Embodiments described herein relate generally to a postprocessing apparatus and an image processing system.

BACKGROUND

An image processing system includes an image processing apparatus and a postprocessing apparatus. For example, the image processing apparatus is used as an image forming apparatus that forms an image on a sheet. The postprocessing apparatus includes a binding mechanism that binds sheets (e.g., performing a stapling process) after image processing is performed on the sheets. The postprocessing apparatus includes a tray on which a bound sheet bundle after the binding process is stacked. The postprocessing apparatus includes a horizontal alignment plate that aligns the sheet bundle in a sheet width direction. For example, the binding mechanism performs a binding process at a predetermined position (for example, near upper right corners of the sheets) of the sheet bundle. When many sheet bundles after the binding process (i.e., bound sheet bundles) are stacked on the tray, a portion of the bound sheet bundle on a needle side is swollen due to the thickness of a staple needle. The postprocessing apparatus alternately offsets a predetermined number of bound sheet bundles in the sheet width direction so that the swelling by the needle is lowered. However, when many bound sheet bundles are piled on the tray, the swollen portion by the needle collides with the horizontal alignment plate in some cases. In these cases, there is a possibility of an obstruction occurring in the aligning of the horizontal alignment plate that binds the sheets. Therefore, for the postprocessing apparatus, there is a request for inhibiting the obstruction in the aligning of the horizontal alignment plate.

DETAILED DESCRIPTION

In general, according to one embodiment, there is provided a postprocessing apparatus including a binding mechanism, a tray, and a shift mechanism. The binding mechanism binds sheets. The bound sheets after the binding process are stacked on the tray. A horizontal alignment plate aligns the sheets in a sheet width direction. The shift mechanism shifts the processed sheets so that swollen portions of the processed sheets are shifted to the inside of the horizontal alignment plate in the sheet width direction when the processed sheets are piled to the vicinity of the horizontal alignment plate on the tray.

Figure 1:
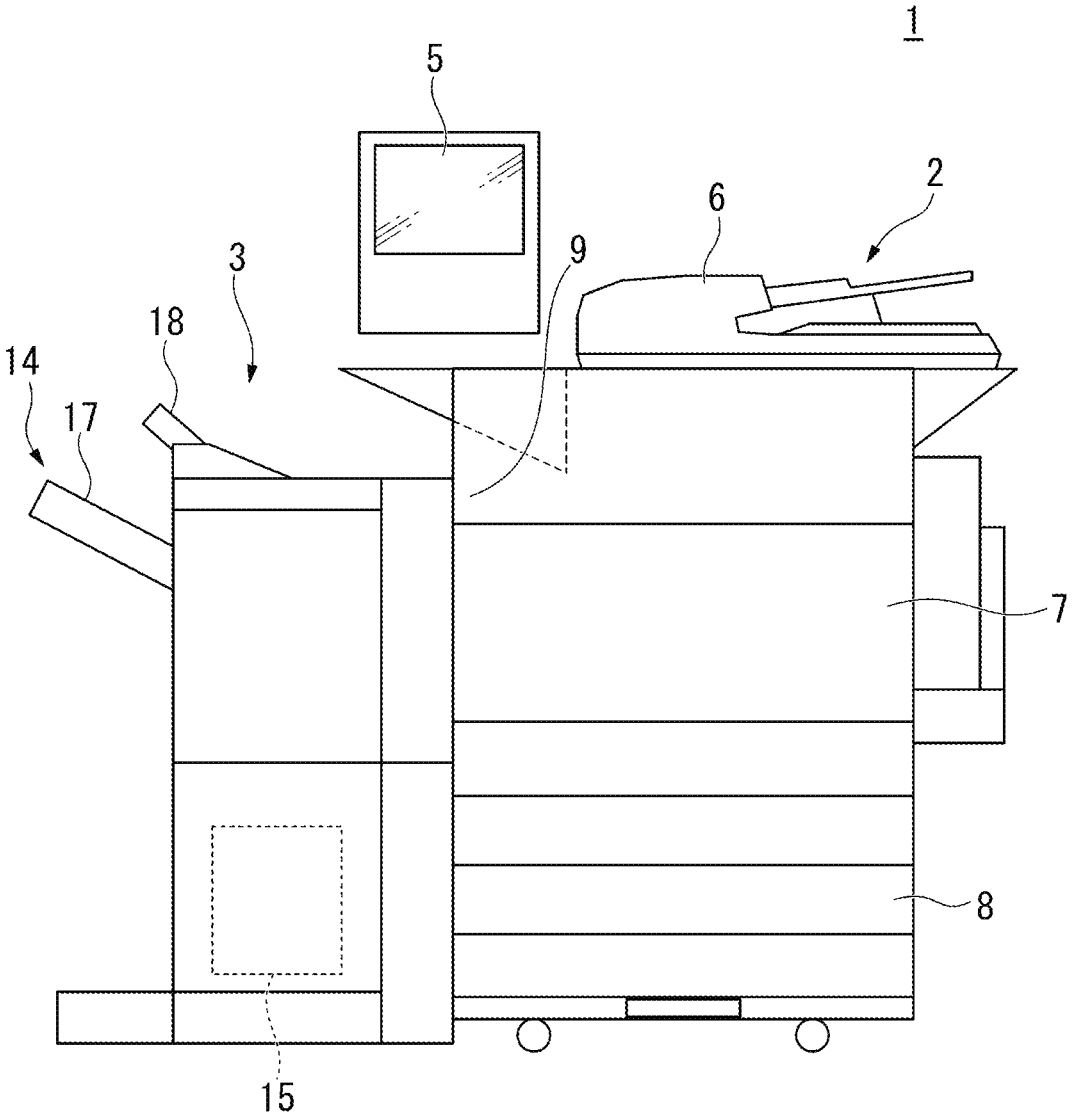
FIG. 1 is a schematic view illustrating a configuration of an image processing system according to a first embodiment.

Hereinafter, a postprocessing apparatus and an image processing system according to a first embodiment will be described with reference to the drawings. FIG. 1 is a schematic view illustrating a configuration of an image processing system 1 according to a first embodiment. As illustrated in FIG. 1, the image processing system 1 includes an image forming apparatus 2 (e.g., an image processing apparatus) and a postprocessing apparatus 3.

The image forming apparatus 2 forms an image on a sheet-shaped recording medium such as a paper sheet (hereinafter referred to as a "sheet"). The postprocessing apparatus 3 performs postprocessing on a sheet conveyed from the image forming apparatus 2. The postprocessing may be any process as long as the postprocessing is a process performed after an image is formed by the image forming apparatus 2. For example, the postprocessing includes a stapling process (e.g., a binding process) of binding sheets with a staple needle.

The image forming apparatus 2 includes a control panel (e.g., an operation unit) 5, a scanner unit 6, a printer unit 7, a feeding unit 8, and a discharging unit 9.

The control panel 5 includes various keys or a touch panel that receives an operation from a user. The control panel 5 receives an input of a type of postprocessing on a sheet. Information regarding the type of postprocessing input with the control panel 5 is transmitted to the postprocessing apparatus 3.

For example, the control panel 5 receives a selection (e.g., a user selection) of a sorting mode in which a sorting process is performed, a staple mode in which a stapling process is performed, or a non-sorting mode in which neither the sorting process nor the stapling process is performed. The image forming apparatus 2 transmits information regarding a discharging destination of the sheets and the mode selected with the control panel 5 to the postprocessing apparatus 3.

The scanner unit 6 includes a reading unit that reads image information of a copy target. The scanner unit 6 transmits the read image information to the printer unit 7. The printer unit 7 forms an output image with a developer such as toner based on the image information transmitted from the scanner unit 6 or an external apparatus. The printer unit 7 heats and pressurizes a toner image transferred to a sheet to fix the toner image to the sheet. The feeding unit 8 supplies sheets to the printer unit 7 one by one at a timing at which the printer unit 7 forms the toner image. The discharging unit 9 conveys the sheet discharged from the printer unit 7 to the postprocessing apparatus 3.

Next, the postprocessing apparatus 3 will be described. As illustrated in FIG. 1, the postprocessing apparatus 3 is disposed adjacent to the image forming apparatus 2. The postprocessing apparatus 3 performs postprocessing designated with the control panel 5 on sheets conveyed from the image forming apparatus 2.

Figure 2:
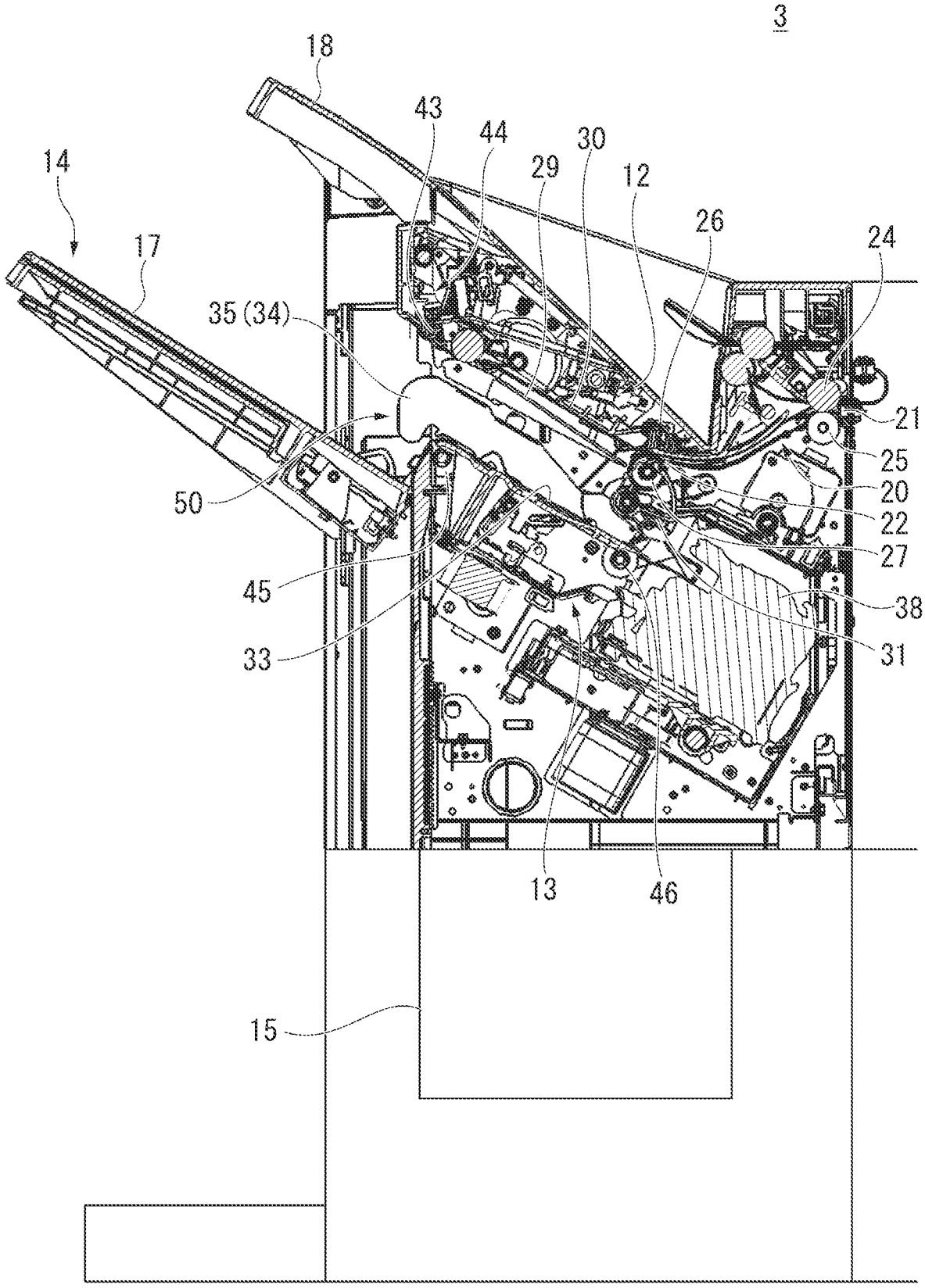
FIG. 2 is a schematic view illustrating a configuration of a postprocessing apparatus.

FIG. 2 is a schematic view illustrating a configuration of the postprocessing apparatus 3 according to the first embodiment. As illustrated in FIG. 2, the postprocessing apparatus 3 includes a standby unit 12, a processing unit 13, a discharging unit 14, and a postprocessing control unit 15.

The standby unit 12 temporarily retains (e.g., buffers) a sheet conveyed from the image forming apparatus 2 (see FIG. 1). The standby unit 12 includes a standby tray 29 that receives a sheet conveyed from the image forming apparatus 2. For example, the standby unit 12 causes a plurality of subsequent sheets to stand by while the processing unit 13 performs postprocessing on a preceding sheet. The standby unit 12 is disposed above the processing unit 13. For example, the standby unit 12 stacks a plurality of preset sheets and causes them to stand by. When the processing unit 13 becomes empty, the standby unit 12 causes the retained sheet to fall toward the processing unit 13.

The processing unit 13 includes a processing tray 33 that receives the sheet falling from the standby unit 12. The processing unit 13 performs the postprocessing on the conveyed sheet. The processing unit 13 performs the postprocessing on the sheet bundle in which the plurality of sheets are aligned. For example, the postprocessing performed by the processing unit 13 is a binding process (e.g., a stapling process) by a stapler 38 (e.g., a binding mechanism, a binder). The processing unit 13 discharges the postprocessed sheet to the discharging unit 14.

The discharging unit 14 includes a movable tray 17 (e.g., a repositionable tray) and a fixed tray 18. The movable tray 17 and the fixed tray 18 are exposed to the outside of the body of the postprocessing apparatus 3. The discharging unit 14 includes a sheet discharging port through which the sheet can be discharged to the movable tray 17 and the fixed tray 18.

The movable tray 17 is provided on a lateral side of the postprocessing apparatus 3. The movable tray 17 can discharge the sheet from the processing unit 13 after the postprocessing. The movable tray 17 can move in the vertical direction (e.g., up or down) along the lateral portion of the postprocessing apparatus 3. The fixed tray 18 is provided above the postprocessing apparatus 3. For example, the sheet can be directly discharged from the discharging unit 9 (see FIG. 1) of the image forming apparatus 2 to the fixed tray 18.

The postprocessing control unit 15 (e.g., a postprocessing controller) controls an operation of the entire postprocessing apparatus 3. The postprocessing control unit 15 includes a processor, a memory, a storage unit, and the like connected via a bus. The postprocessing control unit 15 controls an operation of each functional unit of the postprocessing apparatus 3. For example, the postprocessing control unit 15 controls the standby unit 12, the processing unit 13, and the discharging unit 14.

Hereinafter, an upstream side (e.g., the side of the image forming apparatus 2) in a sheet conveyance direction is referred to as an "upstream side." The downstream side (e.g., the side of the discharging unit 14) in the sheet conveyance direction is referred to as a "downstream side." The end portion downstream in the sheet conveyance direction is referred to as a "front end portion." The end portion upstream in the sheet conveyance direction is referred to as a "rear end portion." A direction which is parallel to the plane of a sheet (e.g., a sheet surface direction) and is orthogonal to the sheet conveyance direction is referred to as a "sheet width direction."

As illustrated in FIG. 2, the postprocessing apparatus 3 includes a conveyance path 20 along which a sheet is conveyed after the discharging unit 9 (see FIG. 1) of the image forming apparatus 2. The conveyance path 20 includes a sheet supply port 21 and a sheet export port 22.

In the sheet supply port 21, a pair of entrance rollers 24 and 25 are provided. The sheet supply port 21 faces the discharging unit 9 (see FIG. 1) of the image forming apparatus 2. A sheet is supplied from the image forming apparatus 2 to the sheet supply port 21. In the sheet export port 22, a pair of exit rollers 26 and 27 are provided. The sheet export port 22 faces the standby unit 12. The sheet passing along the conveyance path 20 is conveyed from the sheet export port 22 to the standby unit 12. For example, the postprocessing control unit 15 (see FIG. 1) controls operations of the entrance rollers 24 and 25 and the exit rollers 26 and 27. The entrance rollers 24 and 25 and the exit rollers 26 and 27 convey the sheet to the standby tray 29.

The standby unit 12 includes the standby tray 29 and an assist guide 30. The rear end portion of the standby tray 29 is disposed near the exit rollers 26 and 27. The rear end portion of the standby tray 29 is disposed below the sheet export port 22 of the conveyance path 20. The standby tray 29 is inclined in the horizontal direction to be gradually raised downstream in the sheet conveyance direction. The standby tray 29 stacks the plurality of sheets and causes them to stand by while the processing unit 13 performs the postprocessing.

The standby tray 29 includes a pair of tray members which can approach and be separated from each other in the sheet width direction. The pair of tray members can approach each other to support a sheet when the sheet stands by in the standby tray 29. The pair of tray members are separated from each other when the sheet is moved from the standby tray 29 to the processing tray 33 of the processing unit 13. Thus, the standby tray 29 causes the supported sheet to move (e.g., fall) toward the processing tray 33.

The assist guide 30 is provided above the standby tray 29. For example, the assist guide 30 has a length which is substantially the same as the standby tray 29 in the sheet conveyance direction. The assist guide 30 urges the sheet toward the processing tray 33 when the sheet is moved from the standby tray 29 to the processing tray 33. The assist guide 30 has a pivot shaft at the end portion downstream in the sheet conveyance direction. The assist guide 30 pivots the end portion upstream in the sheet conveyance direction from the pivot shaft downwards to urge the sheet toward the processing tray 33.

A paddle 31 is provided between the rear end portion of the standby tray 29 and the rear end portion of the processing tray 33. The paddle 31 is rotated about a rotational shaft in the sheet width direction to pressurize the sheet toward the processing tray 33. The paddle 31 pressurizes the rear end portion of the sheet toward the processing tray 33 when the sheet is moved from the standby tray 29 to the processing tray 33. For example, the paddle 31 is formed of an elastic member such as rubber.

Figure 3:
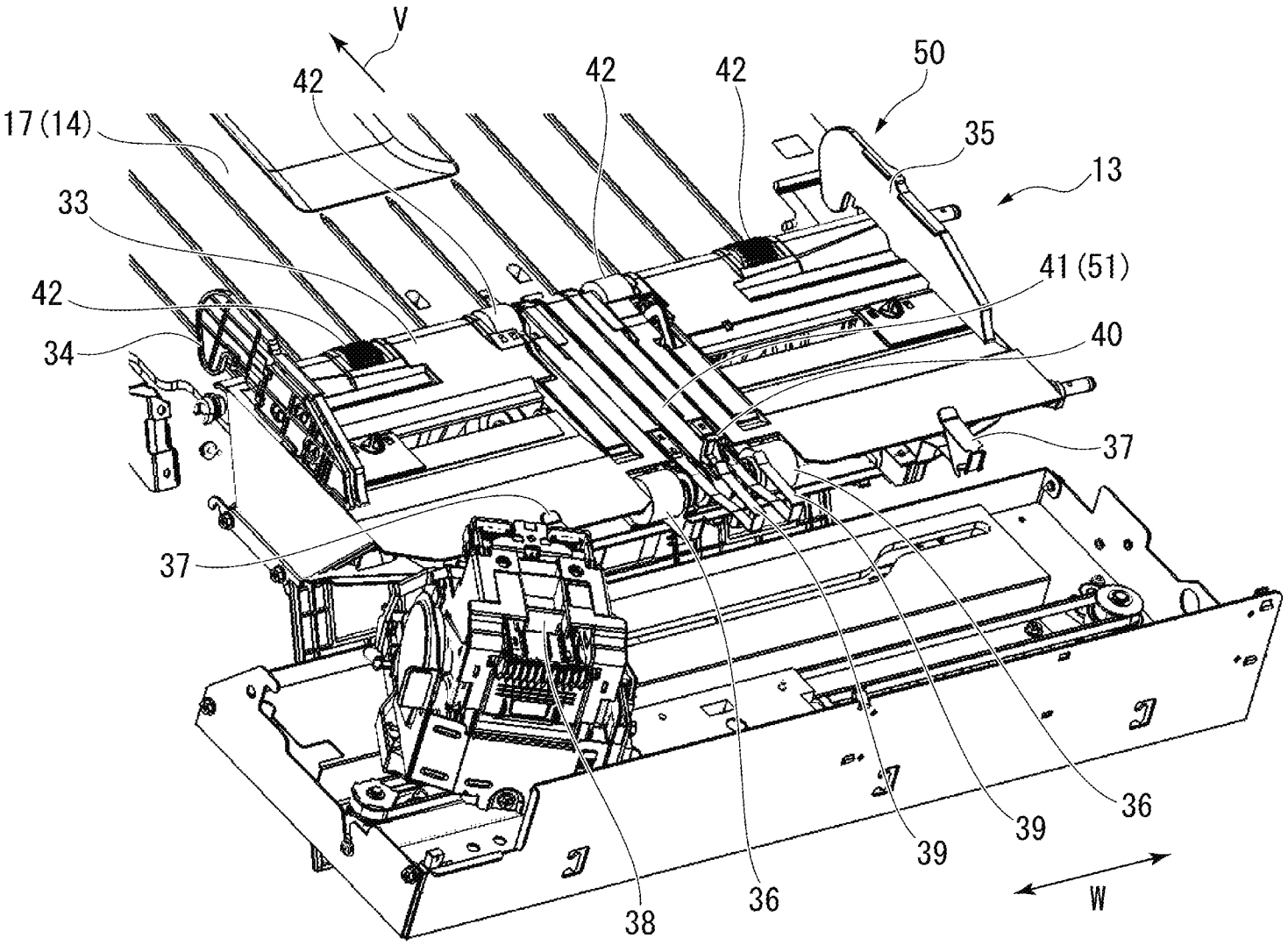
FIG. 3 is a perspective view illustrating the postprocessing apparatus when viewed upstream in a sheet conveyance direction.
Figure 4:
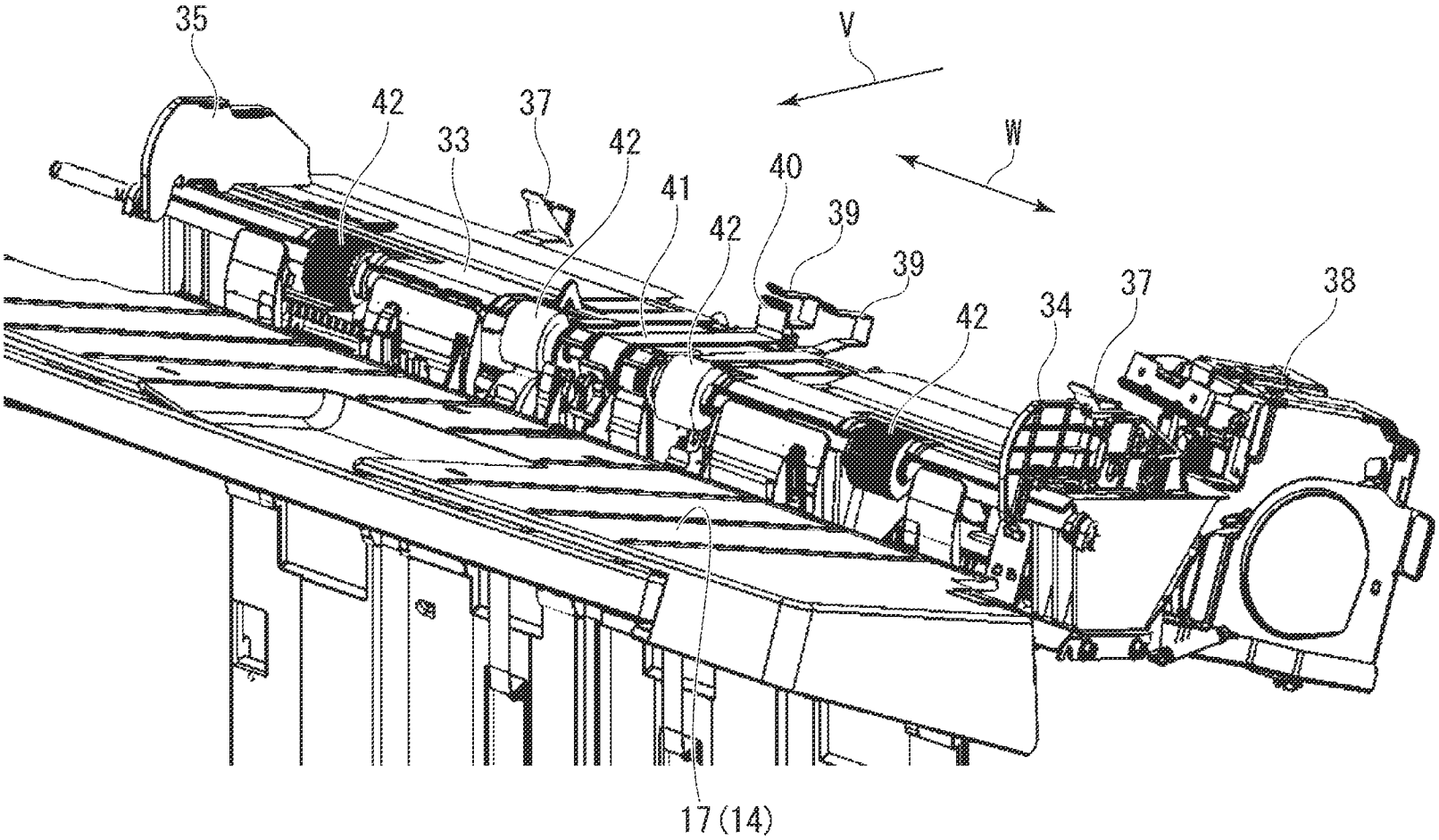
FIG. 4 is a perspective view illustrating the postprocessing apparatus when viewed downstream in the sheet conveyance direction.

FIG. 3 is a perspective view illustrating the postprocessing apparatus 3 according to the first embodiment when viewed upstream in a sheet conveyance direction. FIG. 4 is a perspective view illustrating the postprocessing apparatus 3 when viewed downstream in the sheet conveyance direction according to the first embodiment. In FIGS. 3 and 4, V indicates the sheet conveyance direction and W indicates the sheet width direction. As illustrated in FIG. 3, the processing unit 13 includes the processing tray 33, horizontal alignment plates 34 and 35, vertical alignment rollers 36, rear end stoppers 37, a stapler 38, ejectors 39, a retention claw 40, a belt 41, and discharging rollers 42 and 43 (see FIG. 2).

As illustrated in FIG. 2, the processing tray 33 is provided below the standby tray 29. The processing tray 33 is inclined in the horizontal direction to be gradually raised downstream in the sheet conveyance direction. For example, the processing tray 33 is inclined parallel to the standby tray 29. The processing tray 33 has a conveyance surface (e.g., the upper surface) which supports the sheet (on which the sheet is mounted).

As illustrated in FIG. 4, the horizontal alignment plates 34 and 35 are provided on the conveyance surface (e.g., the upper surface) of the processing tray 33. The pair of horizontal alignment plates 34 and 35 are provided such that they are separated from each other in the sheet width direction W. The pair of horizontal alignment plates 34 and 35 have inner surfaces facing each other in the sheet width direction W. The horizontal alignment plates 34 and 35 can move in an approaching direction and a separation direction in the sheet width direction W. The horizontal alignment plates 34 and 35 form a horizontal alignment device that aligns sheets in the sheet width direction W (so-called horizontal alignment). For example, the horizontal alignment is performed when the inner surfaces of the horizontal alignment plates 34 and 35 in the sheet width direction W come into contact with lateral surfaces of the sheets.

As illustrated in FIG. 3, the vertical alignment rollers 36 and the rear end stoppers 37 are provided at the rear end portion of the processing tray 33. The vertical alignment rollers 36 convey the sheets mounted on the processing tray 33 toward the rear end stoppers 37 jointly with the discharging rollers 42. The vertical alignment rollers 36 and the discharging rollers 42 bring the sheet in contact with the rear end stoppers 37 to align the sheets in the sheet conveyance direction V (so-called vertical alignment).

The stapler 38 is provided at the rear end portion of the processing tray 33. When the staple mode is selected, the stapler 38 staples (e.g., binds) a bundle of a plurality of sheets mounted on the processing tray 33. The stapler 38 can move a specified range so that a predetermined position (for example, a position instructed on the control panel by a user) of a sheet bundle is stapled.

The ejector 39 is provided at the rear end portion of the processing tray 33. The ejector 39 can be moved downstream in the sheet conveyance direction V. The ejector 39 picks up the postprocessed sheet bundle to the retention claw 40.

Figure 5:
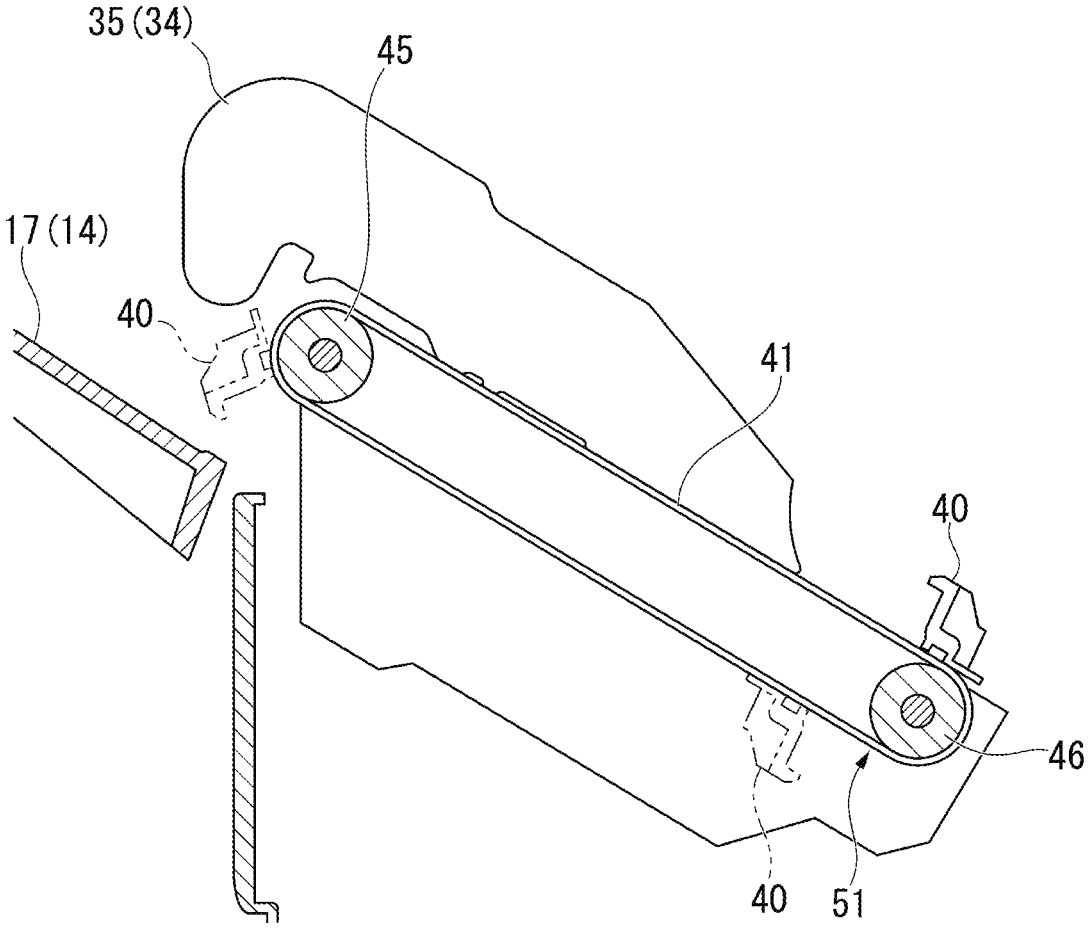
FIG. 5 is a schematic view illustrating a configuration of a shift mechanism.

The retention claw 40 can retain the sheet bundle upstream in the sheet conveyance direction V. The retention claw 40 is fixed to the belt 41. As illustrated in FIG. 5, the belt 41 is stretched over a pair of pulleys 45 and 46. The pair of pulleys 45 and 46 rotate in conjunction with rotation driving of a driving roller of the processing tray 33. The belt 41, the pulleys 45 and 46, and the driving roller form a movement mechanism 51 (e.g., a retention claw actuator) that can move the retention claw 40.

The retention claw 40 moves in the sheet conveyance direction V and its opposite direction with the movement of the belt 41. In FIG. 5, the retention claw 40 disposed at the rear end portion of the belt 41 is indicated by a solid line. The retention claw 40 disposed at the front end portion and an upstream lower portion of the belt 41 with movement of the belt 41 is indicated by a dotted line. As illustrated in FIG. 4, the retention claw 40 discharges a bundle of sheets picked up from the ejector 39 toward the movable tray 17 of the discharging unit 14 along with the discharging rollers 42.

The discharging rollers 42 and 43 include a discharging driving roller 42 and a discharging pinch roller 43. The discharging driving roller 42 is provided at the front end portion of the processing tray 33. The discharging driving roller 42 comes into downward contact with the sheet guided to the conveyance surface (e.g., the upper surface) of the processing tray 33. The discharging driving roller 42 discharges the sheet mounted on the processing tray 33 from the processing tray 33 to the movable tray 17 of the discharging unit 14.

As illustrated in FIG. 2, the discharging pinch roller 43 is provided above the discharging driving roller 42 (see FIG. 4). The discharging pinch roller 43 is a driven roller (e.g., a passive roller) that has no driving source. The discharging pinch roller 43 can be moved between a standby position located above the standby tray 29 and a rotational position facing the discharging driving roller 42. The discharging pinch roller 43 is driven by a pinch roller driving mechanism 44 to be moved between the standby position and the rotational position. The discharging pinch roller 43 is moved to the rotational position to interpose the sheet between the discharging pinch roller 43 and the discharging driving roller 42. Thus, rotation of the discharging driving roller 42 is stably delivered to the sheet.

The postprocessing control unit 15 (see FIG. 1) determines an operation mode of the image processing system 1. For example, the postprocessing control unit 15 determines that the operation mode of the postprocessing apparatus 3 is the postprocessing mode when an automatic postprocessing mode is selected on the control panel 5. The postprocessing control unit 15 determines that the operation mode of the postprocessing apparatus 3 is a manual operation mode when the manual operation mode is selected on the control panel 5.

The postprocessing control unit 15 instructs the processing unit 13 (see FIG. 2) to perform an aligning process. The aligning process is a process of aligning the positions of the end portions of a plurality sheets in the width direction and the longitudinal direction of the plurality of sheets. When the processing unit 13 performs the aligning process, the horizontal alignment plates 34 and 35 and the vertical alignment rollers 36 operate to align the positions of the end portions of the plurality of sheets in the width direction and the longitudinal direction of the sheets. The longitudinal direction of the sheet is a sheet surface direction and a direction oriented in the sheet conveyance direction.

The postprocessing control unit 15 instructs the stapler 38 (see FIG. 2) to perform the postprocessing. The stapler 38 instructed to perform the postprocessing binds the sheet bundle. The postprocessing control unit 15 instructs the ejectors 39 (see FIG. 3) to perform a discharging process. The ejectors 39 instructed to perform the discharging process discharges the postprocessed sheet bundle to the outside of the postprocessing apparatus 3.

Next, a shift mechanism 50 (e.g., a shift actuator assembly, a shift assembly, etc.) will be described. As illustrated in FIG. 2, the postprocessing apparatus 3 includes the shift mechanism 50 that shifts the sheets subjected to the binding process (hereinafter also referred to as a "bound sheet bundle"). As illustrated in FIG. 3, the shift mechanism 50 includes the horizontal alignment plates 34 and 35, the rear end stoppers 37, the ejectors 39, the retention claw 40, the movement mechanism 51, and the discharging driving rollers 42, as described above.

The horizontal alignment plates 34 and 35 are movable (e.g., by one or more alignment plate actuators, such as electric motors) from the standby position to alignment position located further inside than the standby position in the sheet width direction W. The "standby position" mentioned in the present specification is a position at which the inner surfaces of the horizontal alignment plates 34 and 35 are away from the lateral surfaces of the sheet bundle in the sheet width direction W. The "alignment position" mentioned in the present specification is a position at which the inner surfaces of the horizontal alignment plates 34 and 35 come into contact with the lateral surfaces of the sheet bundle in the sheet width direction W.

Figure 6:
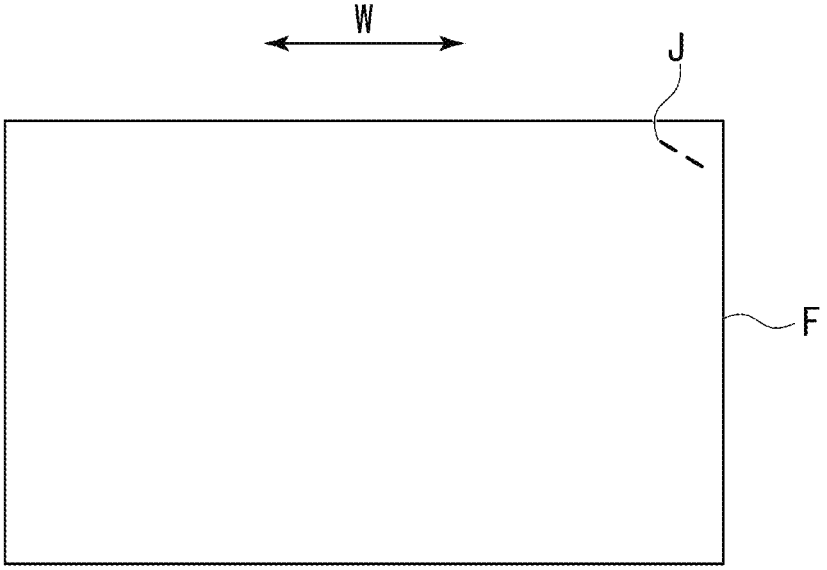
FIG. 6 is a plan view illustrating a bound position of a bound sheet bundle.

The shift mechanism 50 shifts the bound sheet bundle so that the lateral surface of the bound sheet bundle (i.e., the processed sheets) on the binding position side is the same as the alignment position or is located further inside than the alignment position in the sheet width direction W. As illustrated in FIG. 6, in the embodiment, only one portion near the upper right corner of the rectangular sheet bundle that has a rectangle in the sheet width direction W in a plan view is bound. The "lateral surface of the bound sheet bundle on the binding position side" mentioned in the present specification is a right lateral surface of the bound sheet bundle in a plan view. In FIG. 6, F indicates the lateral surface of the bound sheet bundle on the binding position side.

Figure 7:
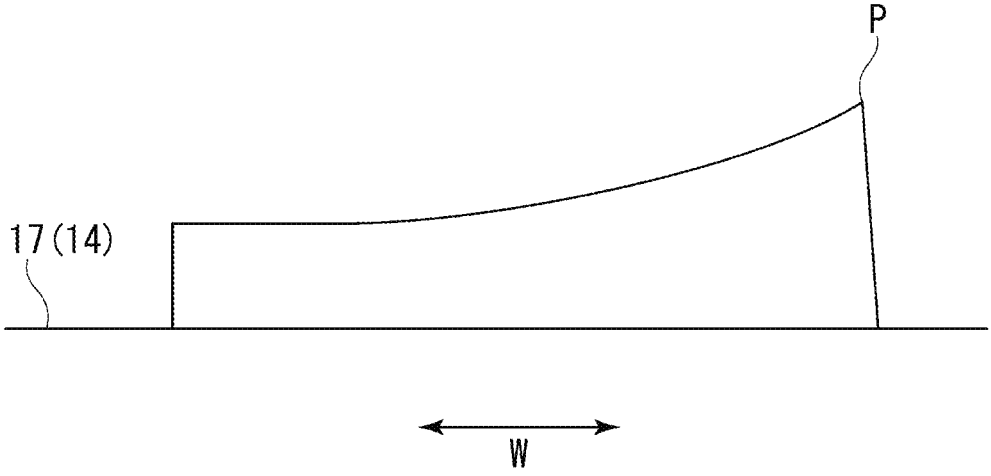
FIG. 7 is a front view illustrating a swollen portion of the bound sheet bundle.

As illustrated in FIG. 7, when many bound sheet bundles are piled on the movable tray 17, the portions of the bound sheet bundles on the binding position side are swollen. In the embodiment, only one portion near the upper right corner of the rectangular sheet bundle that has the rectangle in a plan view, as described above, is bound. Therefore, many bound sheet bundles piled on the movable tray 17 have a swollen portion P at the right end in a front view.

Figure 8:
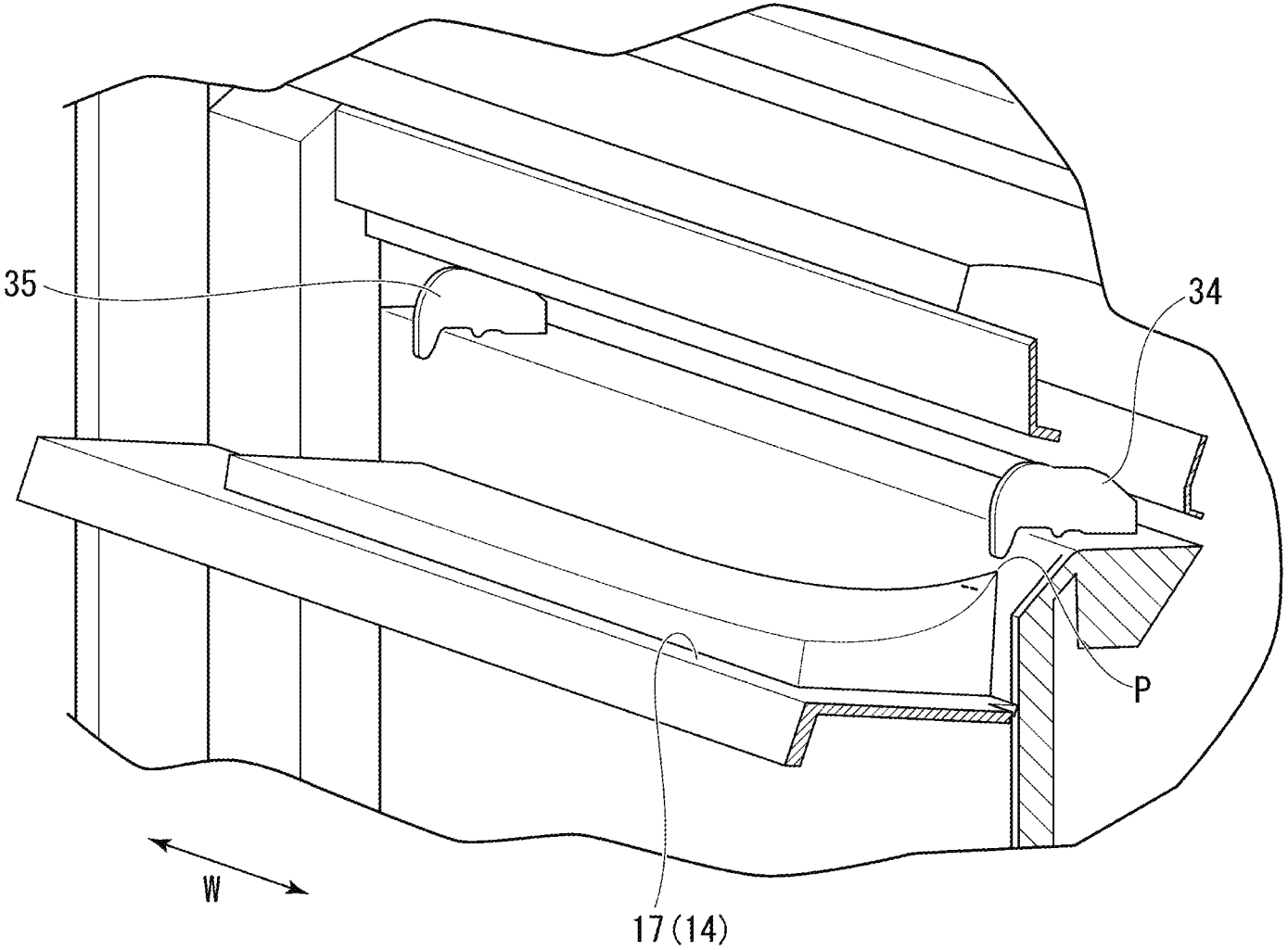
FIG. 8 is a perspective view illustrating the swollen portion of the bound sheet bundle.

In FIG. 8, the horizontal alignment plate 34 is a horizontal alignment plate disposed on one side (e.g., the right side in a front view) in the sheet width direction W (hereinafter also referred to as a "first horizontal alignment plate) and the horizontal alignment plate 35 is a horizontal alignment plate disposed on the other side (e.g., the left side in a front view) in the sheet width direction W (hereinafter also referred to as a "second horizontal alignment plate). In other words, "the lateral surface of the bound sheet bundle on the binding position side" described above is the lateral surface on the side of the first horizontal alignment plate 34 in the sheet width direction W.

The shift mechanism 50 shifts the bound sheet bundle in the sheet width direction W by pressing the lateral surface of the bound sheet bundle on the binding position side using the first horizontal alignment plate 34 during discharging the bound sheet bundle. The shift mechanism 50 moves the retention claw 40 downstream in the sheet conveyance direction V using the movement mechanism 51 with the bound sheet bundle retained upstream in the sheet conveyance direction by the retention claw 40 during discharging the bound sheet bundle (see FIG. 3).

For example, the retention claw 40 discharges the bound sheet bundle to the movable tray 17 in cooperation jointly with the discharging driving rollers 42. That is, the shift mechanism 50 performs a shifting operation of the horizontal alignment plates 34 and 35 and a discharging operation of the retention claw 40 and the discharging driving rollers 42 to discharge the bound sheet bundle to the movable tray 17 while shifting the bound sheet bundle in the sheet width direction W. The movable tray 17 is an example of a tray on which the bound sheet bundle is stacked.

In the embodiment, the shift mechanism 50 shifts the bound sheet bundle in the sheet width direction W with the discharging pinch roller 43 located at the standby position during discharging the bound sheet bundle. That is, the shift mechanism 50 performs the discharging operation using the discharging driving rollers 42 without using the discharging pinch roller 43 during discharging the bound sheet bundle. Therefore, the bound sheet bundle is not interposed between the discharging driving rollers 42 and the discharging pinch roller 43 during discharging the bound sheet bundle. Thus, the bound sheet bundle can be smoothly shifted in the sheet width direction W during discharging the bound sheet bundle.

The shift mechanism 50 sets the interval (e.g., a distance, an offset distance, etc.) between the pair of horizontal alignment plates 34 and 35 in the sheet width direction W during discharging the bound sheet bundle based on the sheet width of the bound sheet bundle and shifts the bound sheet bundle. In the embodiment, the shift mechanism 50 shifts the bound sheet bundle when the interval between the pair of horizontal alignment plates 34 and 35 in the sheet width direction W during discharging the bound sheet bundle is set to be greater than the sheet width of the bound sheet bundle. That is, the shift mechanism 50 forms gaps between the bound sheet bundle and the horizontal alignment plates 34 and 35 during discharging the bound sheet bundle. For example, a difference between the interval between the pair of horizontal alignment plates 34 and 35 in the sheet width direction W and the sheet width of the bound sheet bundle (hereinafter referred to as a "gap width") is set to a size with which a behavior of the bound sheet bundle can be absorbed during discharging the bound sheet bundle.

For example, the gap width may be set in accordance with information such as the size of the sheet width of the bound sheet bundle and the number of sheets forming the bound sheet bundle and a condition such as a discharging speed of the bound sheet bundle. The shift mechanism 50 may change the size of the gap width during discharging the bound sheet bundle by moving the horizontal alignment plates 34 and 35 in the sheet width direction W.

Figure 9:
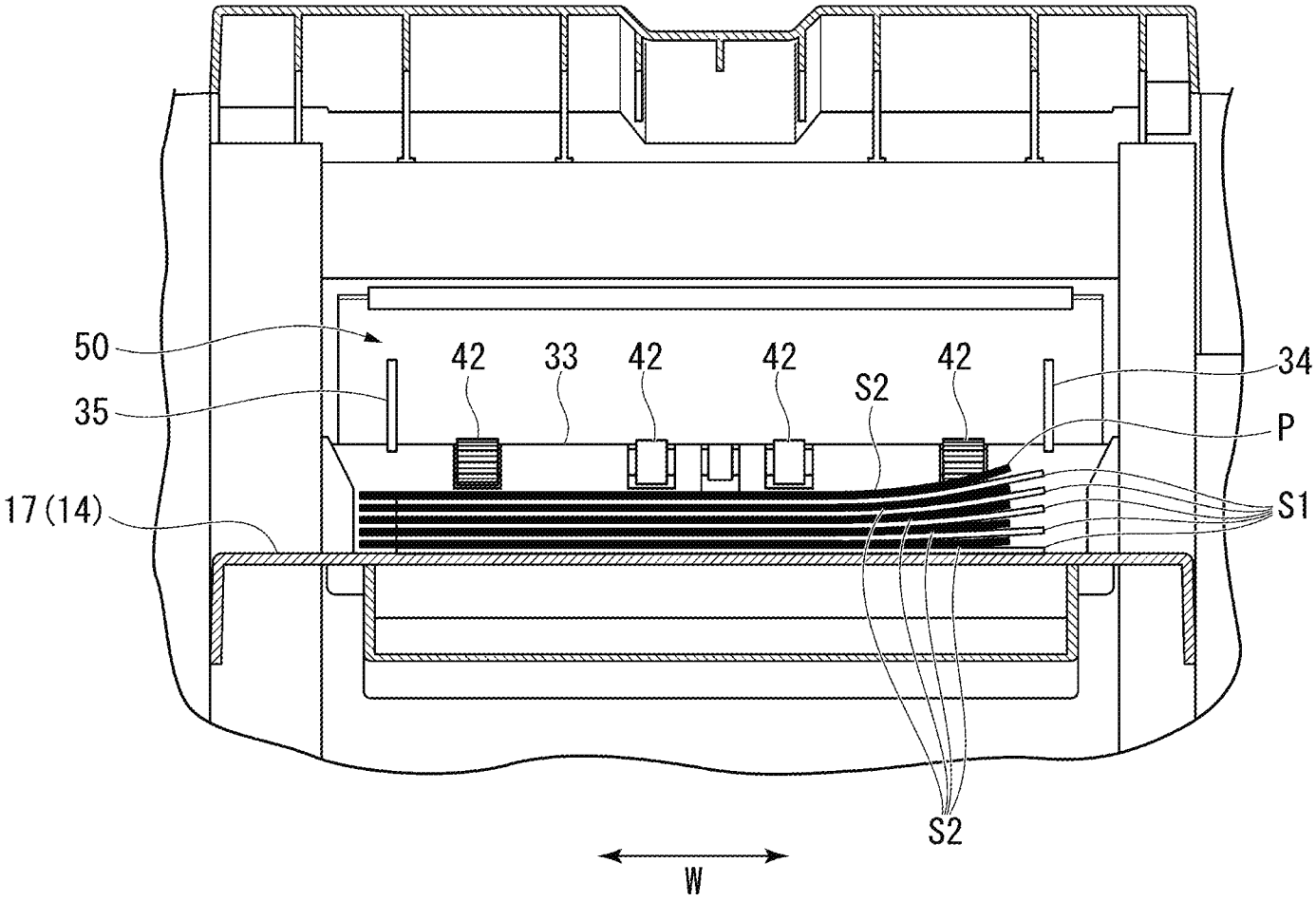
FIG. 9 is a front view illustrating a bound sheet bundle piled on a movable tray in an operation of the shift mechanism.

Next, an example of an operation of the shift mechanism 50 according to the first embodiment will be described. FIG. 9 is a front view illustrating the bound sheet bundle piled on the movable tray 17 in an operation of the shift mechanism 50 according to the first embodiment. In FIG. 9, the horizontal alignment plates 34 and 35 are disposed at the alignment positions.

In the embodiment, the shift mechanism 50 performs an operation of shifting the bound sheet bundle so that the lateral surface of the bound sheet bundle on the binding position side is the same as the alignment position in the sheet width direction W (hereinafter also referred to as an "alignment position shifting operation"). The shift mechanism 50 performs an operation of shifting the bound sheet bundle so that the lateral surface of the bound sheet bundle on the binding position side is located further inside than the alignment position in the sheet width direction W (hereinafter also referred to an "inner position shifting operation"). The shift mechanism 50 alternately repeats the alignment position shifting operation and the inner position shifting operation.

For example, one bound sheet bundle is first stacked on the movable tray 17 through the alignment position shifting operation. In the alignment position shifting operation, one bound sheet bundle is shifted so that the lateral surface of the bound sheet bundle on the binding position side is the same as the alignment position in the sheet width direction W (hereinafter also referred to as an "alignment position sheet bundle"). In FIG. 9, S1 indicates the alignment position sheet bundle.

Subsequently, in the inner position shifting operation, one bound sheet bundle is stacked on the alignment position sheet bundle S1 on the movable tray 17. For example, in the inner position shifting operation, one bound sheet bundle is shifted so that the lateral surface of the bound sheet bundle on the binding position side is located further inside than the alignment position in the sheet width direction W (hereinafter also referred to as an "inner position sheet bundle"). In FIG. 9, S2 indicates the inner position sheet bundle.

In the embodiment, in the inner position shift operation, the inner position sheet bundle S2 is shifted so that the lateral surfaces of the inner position sheet bundle S2 on the binding position side are located further inside than a binding position J (see FIG. 6) of the alignment position sheet bundle S1 in the sheet width direction W. Here, the "binding position J" is equivalent to an inner end of the staple needle provided in the bound sheet bundle in the sheet width direction W. For example, in the inner position shifting operation, the staple needle provided in the inner position sheet bundle S2 may be offset further inside than the staple needle provided in the alignment position sheet bundle S1 in the sheet width direction W.

The shift mechanism 50 alternately repeats the alignment position shifting operation and the inner position shifting operation until the bound sheet bundles are piled to a predetermined height on the movable tray 17. The shift mechanism 50 shifts the bound sheet bundle so that the swollen portion P of the bound sheet bundle is shifted to the inside of the horizontal alignment plate 34 in the sheet width direction W when the bound sheet bundles are piled to the vicinity of the horizontal alignment plate 34 on the movable tray 17 (e.g., when the bound sheet bundles are piled on the movable tray 17 above a predetermined height, such as a height corresponding to a distance between the movable tray 17 and the horizontal alignment plate 34).

The "vicinity of the horizontal alignment plate" mentioned in the present specification is a position which is near the first horizontal alignment plate 34 on the binding position side of the bound sheet bundle between the pair of horizontal alignment plates 34 and 35 and which is close to the first horizontal alignment plate 34 in the vertical direction below a tip lower end of the first horizontal alignment plate 34. Here, the tip lower end of the first horizontal alignment plate 34 is a protrusion end (e.g., a lower end) of the tip of the first horizontal alignment plate 34 protruding in a curved shape downwards to the movable tray 17 in a side view.

For example, the vicinity of the horizontal alignment plate is set to a position away downwards from the tip lower end of the first horizontal alignment plate 34 by the predetermined number of bound sheet bundles. For example, the shift mechanism 50 may shift the bound sheet bundle so that the swollen portion of the bound sheet bundle is shifted to the inside of the first horizontal alignment plate 34 in the sheet width direction W when the bound sheet bundles are piled on the movable tray 17 to a position away downwards from the tip lower end of the first horizontal alignment plate 34 by one bound sheet bundle.

The "swollen portion" mentioned in the present specification is a portion protruding most upwards in the plurality of bound sheet bundles piled on the movable tray 17. As illustrated in FIG. 9, in the embodiment, the swollen portion P is a lateral end of the uppermost inner position sheet bundle S1 on the binding position side among the plurality of bound sheet bundles piled on the movable tray 17.

As described above, the postprocessing apparatus 3 according to the embodiment includes the stapler 38, the movable tray 17, and the shift mechanism 50. The stapler 38 binds sheets. The bound sheet bundle after the binding process is stacked on the movable tray 17. The horizontal alignment plates 34 and 35 align the sheets in the sheet width direction W. The shift mechanism 50 shifts the bound sheet bundle so that the swollen portion P of the bound sheet bundle is shifted to the inside of the horizontal alignment plate 34 in the sheet width direction W when the bound sheet bundles are piled to the vicinity of the horizontal alignment plate 34 on the movable tray 17. Incidentally, when many bound sheet bundles are stacked on the tray, a portion of the bound sheet bundle on the needle side is swollen due to the thickness of the staple needle. The postprocessing apparatus alternately offsets a predetermined number of bound sheet bundles in the sheet width direction so that the swelling by the needle is lowered. However, when many bound sheet bundles are piled on the tray, the swollen portion by the needle collides with the horizontal alignment plate in some cases. In these cases, there is a possibility of an obstruction occurring in the aligning of the horizontal alignment plate that binds the sheets. However, in the postprocessing apparatus 3 according to the embodiment, the shift mechanism 50 shifts the bound sheet bundle so that the swollen portion P of the bound sheet bundle is shifted to the inside of the horizontal alignment plate 34 in the sheet width direction W when the bound sheet bundles are piled to the vicinity of the horizontal alignment plate 34 on the movable tray 17. Thus, even when many bound sheet bundles are piled on the movable tray 17, it is possible to inhibit the collision of the swollen portion P with the horizontal alignment plate 34. Accordingly, it is possible to inhibit occurrence of the obstruction in the aligning operation of the horizontal alignment plates 34 and 35.

The horizontal alignment plate 34 is movable from the standby position to the alignment position further inside than the standby position in the sheet width direction W. The shift mechanism 50 shifts the bound sheet bundle so that the lateral surface of the bound sheet bundle on the binding position side is the same as the alignment position in the sheet width direction W or is located further inside than the alignment position. In the foregoing configuration, the following advantages can be obtained. Since positions to which the bound sheet bundle is shifted in the sheet width direction W are set as only two stages, it is possible to inhibit occurrence of the obstruction in the aligning operation of the horizontal alignment plates 34 and 35 through a simple operation. Further, through the simple operation, it is possible to inhibit a swelling amount (e.g., the height of the swollen portion P) of the bound sheet bundle piled on the movable tray 17.

The shift mechanism 50 alternately repeats an operation of shifting the bound sheet bundle so that the lateral surface of the bound sheet bundle on the binding position side is the same as the alignment position in the sheet width direction W and an operation of shifting the bound sheet bundle so that the lateral surface of the bound sheet bundle on the binding position side is located further inside than the alignment position in the sheet width direction W. In the foregoing configuration, the following advantages are obtained. Since the shifting operations at two stages only have to be alternately repeated, it is possible to inhibit the occurrence of the obstruction in the aligning operation of the horizontal alignment plates 34 and 35 through a simple operation. Further, through the simple operation, it is possible to inhibit a swelling amount (e.g., the height of the swollen portion P) of the bound sheet bundle piled on the movable tray 17.

The shift mechanism 50 includes the horizontal alignment plates 34 and 35. In the foregoing configuration, the following advantages are obtained. The horizontal alignment plates 34 and 35 have a function of aligning the sheets in the sheet width direction W and a function of shifting the bound sheet bundle. Therefore, in comparison to the shift mechanism 50 that has a member (for example, a member only for a shifting operation) different from the horizontal alignment plates, an apparatus configuration is simplified to contribute to low cost.

The shift mechanism 50 shifts the bound sheet bundle by pressing the lateral surface of the bound sheet bundle on the binding position side using the horizontal alignment plate 34 during discharging the bound sheet bundle. In the foregoing configuration, the following advantages are obtained. The shift mechanism 50 has an operation of discharging the bound sheet bundle and an operation of shifting the bound sheet bundle. Therefore, in comparison to a shifting operation before the bound sheet bundle is discharged, a standby time for the shifting operation is not necessary. Accordingly, it is possible to smoothly perform the process of discharging the bound sheet bundle.

The shift mechanism 50 further includes the retention claw 40 capable of retaining the bound sheet bundle upstream in the sheet conveyance direction V and the movement mechanism 51 capable of moving the retention claw 40 downstream in the sheet conveyance direction V during discharging the bound sheet bundle. In the foregoing configuration, the following advantages are obtained. It is possible to discharge the bound sheet bundle while causing the retention claw 40 to retain the vertical alignment of the bound sheet bundle. Accordingly, it is possible to stack the bound sheet bundle with precision at a desired position on the movable tray 17.

One pair of horizontal alignment plates 34 and 35 are provided in the sheet width direction W. The shift mechanism 50 sets the interval between the pair of horizontal alignment plates 34 and 35 in the sheet width direction W during discharging the bound sheet bundle based on the sheet width of the bound sheet bundle and shifts the bound sheet bundle. In the foregoing configuration, the following advantages are obtained. In comparison to the shifting of the bound sheet bundle using only one of the pair of horizontal alignment plates 34 and 35 during discharging the bound sheet bundle, it is possible to discharge the bound sheet bundle stably.

The shift mechanism 50 shifts the bound sheet bundle when the interval between the pair of horizontal alignment plates 34 and 35 in the sheet width direction W during discharging the bound sheet bundle is greater than the sheet width of the bound sheet bundle. In the foregoing configuration, the following advantages are obtained. Due to the difference between the interval between the pair of horizontal alignment plates 34 and 35 in the sheet width direction W and the sheet width of the bound sheet bundle (e.g., a gap width), it is possible to absorb a behavior of the bound sheet bundle during discharging the bound sheet bundle. Accordingly, in comparison to the shifting of the bound sheet bundle when the interval between the pair of horizontal alignment plates 34 and 35 in the sheet width direction W during discharging the bound sheet bundle is the same as the sheet width of the bound sheet bundle, it is possible to discharge the bound sheet bundle stably.

The image processing system 1 according to the embodiment includes the above-described postprocessing apparatus 3. Even when many bound sheet bundles are piled on the movable tray 17, the postprocessing apparatus 3 can inhibit collision of the swollen portion P with the horizontal alignment plate 34. Accordingly, the image processing system 1 can inhibit occurrence of the obstruction in the aligning operation of the horizontal alignment plates 34 and 35.

Next, modification examples of the first embodiment will be described. An exemplary embodiment is not limited to the stacking of one bound sheet bundle on the movable tray 17 through the alignment position shifting operation. For example, through the alignment position shifting operation, a plurality of bound sheet bundles may be stacked on the movable tray 17. An exemplary embodiment is not limited to the stacking of one bound sheet bundle on the alignment position sheet bundle S1 on the movable tray 17 through the inner position shifting operation. For example, through the inner position shifting operation, a plurality of bound sheet bundles may be stacked on the alignment position sheet bundle S1 on the movable tray 17. That is, in at least one of the alignment position shifting operation and the inner position shifting operation, the number of bound sheet bundles stacked on the movable tray 17 can be changed in accordance with a requirement specification.

An exemplary embodiment is not limited to the shift mechanism 50 including the horizontal alignment plates 34 and 35. For example, the shift mechanism 50 may include a member (for example, a member only for a shifting operation) different from the horizontal alignment plates. For example, an aspect of the shift mechanism 50 can be changed in accordance with a requirement specification.

An exemplary embodiment is not limited to the shift mechanism 50 that shifts the bound sheet bundle by pressing the lateral surface of the bound sheet bundle on the binding position side using the horizontal alignment plate 34 during discharging the bound sheet bundle. For example, the shift mechanism 50 may perform a shifting operation before the bound sheet bundle is discharged.

An exemplary embodiment is not limited to the shift mechanism 50 that includes the retention claw 40 capable of retaining the bound sheet bundle upstream in the sheet conveyance direction V and the movement mechanism 51 capable of moving the retention claw 40 downstream in the sheet conveyance direction V during discharging the bound sheet bundle. For example, the shift mechanism 50 may not include the retention claw 40 and the movement mechanism 51. For example, the shift mechanism 50 may discharge the bound sheet bundle using only the discharging driving rollers 42.

An exemplary embodiment is not limited to the shift mechanism 50 that sets the interval between the pair of horizontal alignment plates 34 and 35 in the sheet width direction W during discharging the bound sheet bundle based on the sheet width of the bound sheet bundle and that shifts the bound sheet bundle. For example, the shift mechanism 50 may shift the bound sheet bundle using only one of the pair of horizontal alignment plates 34 and 35 during discharging the bound sheet bundle.

An exemplary embodiment is not limited to the shift mechanism 50 that shifts the bound sheet bundle when the interval between the pair of horizontal alignment plates 34 and 35 in the sheet width direction W during discharging the bound sheet bundle is greater than the sheet width of the bound sheet bundle. For example, the shift mechanism 50 may shift the bound sheet bundle when the interval between the pair of horizontal alignment plates 34 and 35 in the sheet width direction W during discharging the bound sheet bundle is the same as the sheet width of the bound sheet bundle.

Next, a second embodiment will be described with reference to FIG. 10. In the second embodiment, the description of the same configurations as those of the first embodiment will be omitted. The shift mechanism 50 according to the first embodiment alternately repeats the shifting operation at two stages. Herein, the shift mechanism 50 according to the second embodiment is different from that of the first embodiment in that the shifting operation is alternately repeated at three stages.

Figure 10:
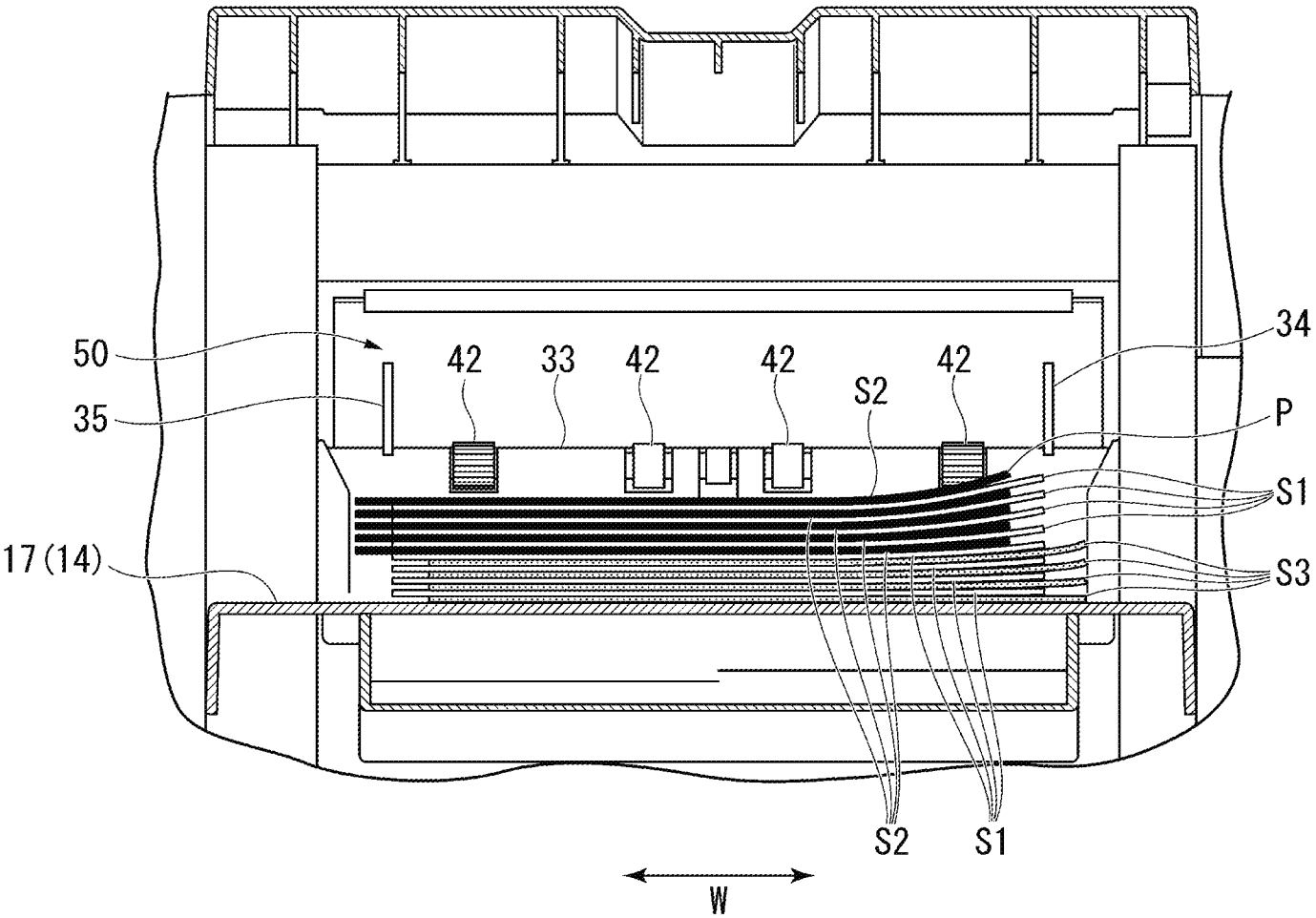
FIG. 10 is a front view illustrating a bound sheet bundle piled on a movable tray in an operation of a shift mechanism according to a second embodiment.

FIG. 10 is a front view illustrating a bound sheet bundle piled on the movable tray 17 in an operation of the shift mechanism 50 according to the second embodiment. In FIG. 10, the horizontal alignment plates 34 and 35 are disposed at an alignment position.

In the embodiment, the shift mechanism 50 performs an operation of shifting the bound sheet bundle so that the lateral surface of the bound sheet bundle on the binding position side is located further outside than the alignment position in the sheet width direction W until the bound sheet bundles are piled to a predetermined height on the movable tray 17 (hereinafter also referred to as an "outer position shifting operation"). The shift mechanism 50 performs an operation of shifting the bound sheet bundle so that the lateral surface of the bound sheet bundle on the binding position side is the same as the alignment position in the sheet width direction W (i.e., an alignment position shifting operation). The shift mechanism 50 performs an operation of shifting the bound sheet bundle so that the lateral surface of the bound sheet bundle on the binding position side is located further inside than the alignment position in the sheet width direction W (i.e., an inner position shifting operation). The shift mechanism 50 performs the alignment position shifting operation or the inner position shifting operation until the bound sheet bundles are piled on the tray to the vicinity of the horizontal alignment plate 34 after the outer position shifting operation.

For example, one bound sheet bundle is first stacked on the movable tray 17 through the outer position shifting operation. In the outer position shifting operation, one bound sheet bundle is shifted so that the lateral surface of the bound sheet bundle on the binding position side is located further outside than the alignment position in the sheet width direction W (hereinafter also referred to as an "outer position sheet bundle"). In FIG. 10, S3 indicates the outer position sheet bundle.

Subsequently, through the alignment position shifting operation, one bound sheet bundle is stacked on the outer position sheet bundle S3 on the movable tray 17. In the alignment position shifting operation, one bound sheet bundle (e.g., the alignment position sheet bundle 51) is shifted so that the lateral surface of the bound sheet bundle on the binding position side is the same as the alignment position in the sheet width direction W.

In the embodiment, in the alignment position shifting operation, the alignment position sheet bundle S1 is shifted so that the lateral surface of the alignment position sheet bundle S1 is located further inside than binding position J (see FIG. 6) of the outer position sheet bundle S3 in the sheet width direction W. For example, in the alignment position shifting operation, the staple needle provided in the outer position sheet bundle S3 may be offset further outside than the staple needle provided in the alignment position sheet bundle S1 in the sheet width direction W.

The shift mechanism 50 alternately repeats the outer position shifting operation and the alignment position shifting operation until the bound sheet bundles are piled to the predetermined height on the movable tray 17. For example, the shift mechanism 50 alternately repeats the outer position shifting operation and the alignment position shifting operation until the first thirty bound sheet bundles are piled on the movable tray 17.

The shift mechanism 50 stacks one bound sheet bundle on the movable tray 17 through the alignment position shifting operation after the bound sheet bundles are piled to the predetermined height on the movable tray 17. In the alignment position shifting operation, one bound sheet bundle (e.g., the alignment position sheet bundle S1) is shifted so that the lateral surface of the bound sheet bundle on the binding position side is the same as the alignment position in the sheet width direction W.

Subsequently, through the inner position shift operation, one bound sheet bundle is stacked on the alignment position sheet bundle S1 on the movable tray 17. For example, in the inner position shift operation, one bound sheet bundle (e.g., the inner position sheet bundle S2) is shifted so that the lateral surface of the bound sheet bundle on the binding position side is located further inside than the alignment position in the sheet width direction W.

In the embodiment, in the inner position shifting operation, the inner position sheet bundle S2 is shifted so that the lateral surface of the inner position sheet bundle S2 on the binding position side is located further inside than the binding position J (see FIG. 6) of the alignment position sheet bundle S1 in the sheet width direction W. For example, in the inner position shifting operation, the staple needle provided in the inner position sheet bundle S2 may be offset further inside than the staple needle provided in the alignment position bundle S1 in the sheet width direction W.

The shift mechanism 50 alternately repeats the alignment position shifting operation and the inner position shifting operation until the bound sheet bundles are piled to the predetermined height on the movable tray 17. The shift mechanism 50 shifts the bound sheet bundle so that the swollen portion P of the bound sheet bundle is shifted to the inside of the horizontal alignment plate 34 in the sheet width direction W when the bound sheet bundles are piled to the vicinity of the horizontal alignment plate 34 on the movable tray 17.

According to the second embodiment, the shift mechanism 50 shifts the bound sheet bundle so that the lateral surface of the bound sheet bundle on the binding position side is located further outside than the alignment position in the sheet width direction W until the bound sheet bundles are piled to the predetermined height on the movable tray 17. Thereafter, the shift mechanism 50 shifts the bound sheet bundle so that the lateral surface of the bound sheet bundle on the binding position side is the same as the alignment position or is located further inside than the alignment position in the sheet width direction W until the bound sheet bundles are pile to the vicinity of the horizontal alignment plate 34 on the movable tray 17. In the foregoing configuration, the following advantages are obtained. Since the shifting operation is performed at three stages, it is possible to inhibit a swollen amount (e.g., the height of the swollen portion P) of the bound sheet bundles piled on the movable tray 17 more efficiently than when the shifting operation is performed at two stages. Accordingly, it is possible to further stack many bound sheet bundles on the movable tray 17. In addition, since the swollen amount of the bound sheet bundles piled on the movable tray 17 is low during the outer position shifting operation, the bound sheet bundles on the movable tray 17 do not interfere with the horizontal alignment plate 34. Therefore, by performing the alignment position shifting operation after the outer position shifting operation and subsequently performing the inner position shifting operation, the bound sheet bundle can be stacked in an inner region in which the swollen amount is lower than in an outer region. Accordingly, it is possible to inhibit the swollen amount of the bound sheet bundles piled on the movable tray 17 within a broad range in the sheet width direction W.

Next, modification examples of the second embodiment will be described. An exemplary embodiment is not limited to the stacking of one bound sheet bundle on the movable tray 17 through the outer position shifting operation. For example, through the outer position shifting operation, a plurality of bound sheet bundles may be stacked on the movable tray 17. An exemplary embodiment is not limited to the stacking of one bound sheet bundle on the outer position sheet bundle S3 on the movable tray 17 through the alignment position shifting operation. For example, through the alignment position shifting operation, a plurality of bound sheet bundles may be stacked on the outer position sheet bundle S3 on the movable tray 17. An exemplary embodiment is not limited to the stacking of one bound sheet bundle on the alignment position sheet bundle S1 on the movable tray through the inner position shifting operation. For example, through the inner position shifting operation, a plurality of bound sheet bundles may be stacked on the alignment position sheet bundle S1 on the movable tray 17. That is, in at least one of the outer position shifting operation, the alignment position shifting operation, and the inner position shifting operation, the number of bound sheet bundles stacked on the movable tray 17 can be changed in accordance with a requirement specification.

An exemplary embodiment is not limited to the shift mechanism 50 that performs the shifting operation at three stages. For example, the shift mechanism 50 may perform the shifting operations at four or more stages. That is, the number of stages of the shifting operation can be changed in accordance with a requirement specification.

Next, a third embodiment will be described with reference to FIG. 11. In the third embodiment, the description of the same configurations as those of the first embodiment will be omitted. The shift mechanism 50 according to the first embodiment alternately repeats the shifting operation at two stages. In contrast, the shift mechanism 50 according to the third embodiment is different from that of the first embodiment in that the shifting operation is alternately repeated at three stages.

Figure 11:
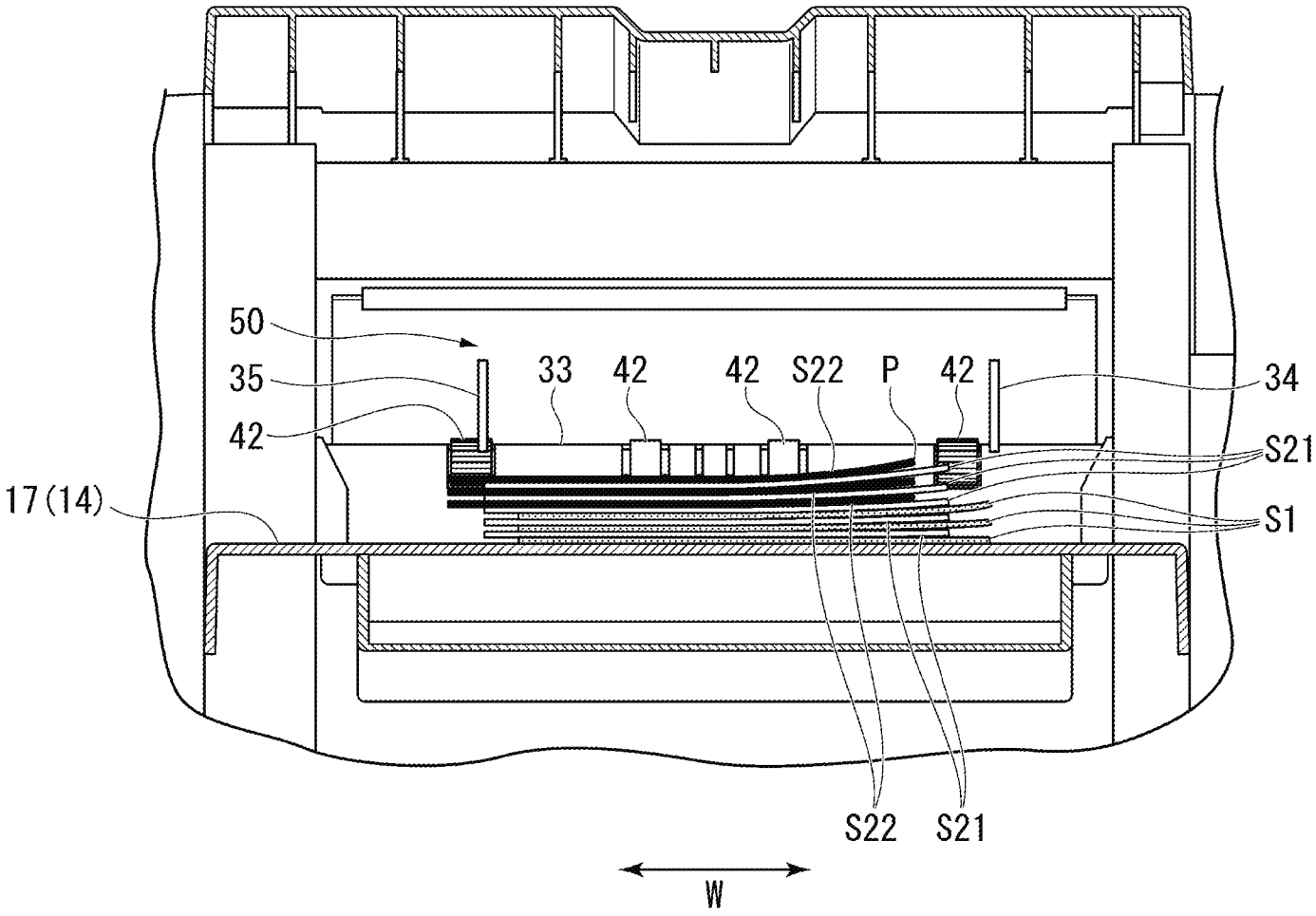
FIG. 11 is a front view illustrating a bound sheet bundle piled on a movable tray in an operation of a shift mechanism according to a third embodiment.

FIG. 11 is a front view illustrating a bound sheet bundle piled on a movable tray in an operation of the shift mechanism 50 according to a third embodiment. In FIG. 11, the horizontal alignment plates 34 and 35 are disposed at an alignment position. An alignment position of the third embodiment is an alignment position at which the shifting operation is performed on a sheet bundle with a sheet width less than that of the sheet bundle of the second embodiment.

In the embodiment, the shift mechanism 50 performs an operation of shifting the bound sheet bundle so that the lateral surface of the bound sheet bundle on the binding position side is the same as the alignment position in the sheet width direction W until the bound sheet bundles are piled to a predetermined height on the movable tray 17 (i.e., an alignment position shifting operation). The shift mechanism 50 performs an operation of shifting the bound sheet bundle so that the lateral surface of the bound sheet bundle on the binding position side is located further inside than the alignment position in the sheet width direction W (hereinafter also referred to as a "first inner position shifting operation"). The shift mechanism 50 performs an operation of shifting the bound sheet bundle so that the lateral surface of the bound sheet bundle on the binding position side is located further inside than the previous shift position in the sheet width direction W (hereinafter also referred to as a "second inner position shifting operation").

For example, one bound sheet bundle is first stacked on the movable tray 17 through the alignment position shifting operation. In the alignment position shifting operation, one bound sheet bundle is shifted so that the lateral surface of the bound sheet bundle on the binding position side is the same as the alignment position in the sheet width direction W (hereinafter also referred to as an "alignment position sheet bundle S1").

Subsequently, through the first inner position shifting operation, one bound sheet bundle is stacked on the movable tray 17. In the first inner position shifting operation, one bound sheet bundle (hereinafter also referred to as a first inner position sheet bundle) is shifted so that the lateral surface of the bound sheet bundle on the binding position side is located further inside than the alignment position in the sheet width direction W. In FIG. 11, S21 indicates the first inner position sheet bundle.

In the embodiment, in the first inner position shifting operation, the first inner position sheet bundle S21 is shifted so that the lateral surface of the first inner position sheet bundle S21 on the binding position side is located further inside than binding position J (see FIG. 6) of the alignment position sheet bundle S1 in the sheet width direction W. For example, in the first inner position shifting operation, the staple needle provided in the first inner position sheet bundle S21 may be offset further inside than the staple needle provided in the alignment position sheet bundle S1 in the sheet width direction W.

The shift mechanism 50 alternately repeats the alignment position shifting operation and the first inner position shifting operation until the bound sheet bundles are piled to the predetermined height on the movable tray 17. For example, the shift mechanism 50 alternately repeats the alignment position shifting operation and the first inner position shifting operation until the first thirty bound sheet bundles are piled on the movable tray 17.

The shift mechanism 50 stacks one bound sheet bundle on the movable tray 17 through the first inner position shifting operation after the bound sheet bundles are piled to the predetermined height on the movable tray 17. In the first inner position shifting operation, one bound sheet bundle (e.g., the first inner position sheet bundle S21) is shifted so that the lateral surface of the bound sheet bundle on the binding position side is located further inside than the alignment position in the sheet width direction W.

Subsequently, through the second inner position shift operation, one bound sheet bundle is stacked on the first inner position sheet bundle S21 on the movable tray 17. For example, in the second inner position shift operation, one bound sheet bundle (hereinafter also referred to as a "second inner position sheet bundle) is shifted so that the lateral surface of the bound sheet bundle on the binding position side is located further inside than the previous shift position in the sheet width direction W. FIG. 11, S22 indicates the second inner position sheet bundle.

In the embodiment, in the second inner position shifting operation, the second inner position sheet bundle S22 is shifted so that the lateral surface of the second inner position sheet bundle S22 on the binding position side is located further inside than the binding position J (see FIG. 6) of the first inner position sheet bundle S21 in the sheet width direction W. For example, in the second inner position shifting operation, the staple needle provided in the second inner position sheet bundle S22 is offset further inside than the staple needle provided in the first inner position sheet bundle S21 in the sheet width direction W.

The shift mechanism 50 alternately repeats the first inner position shifting operation and the second inner position shifting operation until the bound sheet bundles are piled to the predetermined height on the movable tray 17. The shift mechanism 50 shifts the bound sheet bundle so that the swollen portion P of the bound sheet bundle is shifted to the inside of the horizontal alignment plate 34 in the sheet width direction W when the bound sheet bundles are piled to the vicinity of the horizontal alignment plate 34 on the movable tray 17.

According to the third embodiment, the shift mechanism 50 shifts the bound sheet bundle so that the lateral surface of the bound sheet bundle on the binding position side is the same as the alignment position or is located further inside than the alignment position in the sheet width direction W. Thereafter, the shift mechanism 50 shifts the bound sheet bundle so that the lateral surface of the bound sheet bundle on the binding position side is located further inside than the previous shift position in the sheet width direction W. In the foregoing configuration, the following advantages are obtained. Since the shifting operation is performed at three stages, it is possible to inhibit a swollen amount (e.g., the height of the swollen portion P) of the bound sheet bundles piled on the movable tray 17 more efficiently than when the shifting operation is performed at two stages. Accordingly, it is possible to further stack many bound sheet bundles on the movable tray 17. Incidentally, when the sheet width of the sheet bundle is narrower than a predetermined value, an operation range in inclination of the stapler to staple the corner of the sheet bundle and an operation range of the horizontal alignment plates are limited. Therefore, there is a high possibility of a position of a stapling treatment being limited to one position in the sheet bundle. Thus, the sheet bundle may not be shifted to the outside of a needle in the sheet width direction in some case. Even in this case, according to the embodiment, by performing the first inner position shifting operation after the alignment position shifting operation and subsequently performing the second inner position shifting operation, it is possible to perform the shifting operation at three stages. Accordingly, it is possible to inhibit the swollen amount of the bound sheet bundles piled on the movable tray 17 within a limited range in the sheet width direction W.

Next, modification examples of the third embodiment will be described. An exemplary embodiment is not limited to the stacking of one bound sheet bundle on the movable tray 17 through the alignment position shifting operation. For example, through the alignment position shifting operation, a plurality of bound sheet bundles may be stacked on the movable tray 17. An exemplary embodiment is not limited to the stacking of one bound sheet bundle on the alignment position sheet bundle 51 on the movable tray 17 through the first inner position shifting operation. For example, through the first inner position shifting operation, a plurality of bound sheet bundles may be stacked on the alignment position sheet bundle 51 on the movable tray 17. An exemplary embodiment is not limited to the stacking of one bound sheet bundle on the first inner position sheet bundle S21 on the movable tray 17 through the second inner position shifting operation. For example, through the second inner position shifting operation, a plurality of bound sheet bundles may be stacked on the first inner position sheet bundle S21 on the movable tray 17. That is, in at least one of the alignment position shifting operation, the first inner position shifting operation, and the second inner position shifting operation, the number of bound sheet bundles stacked on the movable tray 17 can be changed in accordance with a requirement specification.

An exemplary embodiment is not limited to the shift mechanism 50 that performs the shifting operation at three stages. For example, the shift mechanism 50 may perform the shifting operations at four or more stages. That is, the number of stages of the shifting operation can be changed in accordance with a requirement specification.

Next, other modification examples of the embodiments will be described. The image processing apparatus according to the embodiments is an image forming apparatus that forms an image on a sheet. Here, the image processing apparatus may be a decoloring apparatus that decolors an image formed on a sheet. For example, the decoloring apparatus performs a process of decoloring (e.g., removing) an image formed on a sheet with decolorable toner.

According to at least one of the above-described embodiments, the postprocessing apparatus 3 includes the binding mechanism 38, the tray 17, and the shift mechanism 50. The binding mechanism 38 binds sheets. The bound sheets after the binding process are stacked on the tray 17. The horizontal alignment plate 34 aligns the sheets in the sheet width direction W. The shift mechanism 50 shifts the processed sheets so that the swollen portions P of the processed sheets are shifted to the inside of the horizontal alignment plate 34 in the sheet width direction W when the processed sheets are piled to the vicinity of the horizontal alignment plate 34 on the tray 17. In the foregoing configuration, the following advantages are obtained. The shift mechanism 50 shifts the processed sheets so that the swollen portions P of the processed sheets are shifted to the inside of the horizontal alignment plate 34 in the sheet width direction W when the processed sheets are piled to the vicinity of the horizontal alignment plate 34 on the tray 17. Thus, even when the many processed sheets are piled on the movable tray 17, it is possible to inhibit collision of the swollen portion P with the horizontal alignment plate 34. Accordingly, it is possible to inhibit occurrence of the obstruction in the aligning operation of the horizontal alignment plate 34.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A postprocessing apparatus comprising:

a horizontal alignment plate positioned to align sheets in a sheet width direction the horizontal alignment plate being repositionable between (a) a standby position and (b) an alignment position located further inward than the standby position in the sheet width direction;

a binder configured to bind the sheets to form bound sheet bundles including first bound sheet bundles and second bound sheet bundles;

a tray on which the bound sheet bundles are stacked;

a shift actuator assembly that facilitates shifting the bound sheet bundles in the sheet width direction; and a postprocessing controller operatively coupled to the shift actuator assembly and configured to control the shift actuator assembly to:

shift the first bound sheet bundles such that a lateral surface on a binding position side of each first bound sheet bundle is located outward of the alignment position in the sheet width direction until the first bound sheet bundles are piled to a predetermined height on the tray; and subsequently shift the second bound sheet bundles such that a lateral surface on a binding position side of each second bound sheet bundle side is located at the alignment position or further inward than the alignment position until the second bound sheet bundles are piled to the vicinity of the horizontal alignment plate on the tray.

2. The postprocessing apparatus of claim 1, wherein:

the bound sheet bundles further include a third bound sheet bundle and a fourth bound sheet bundle;

and the postprocessing controller is configured to control the shift actuator assembly to:

shift the third bound sheet bundle such that a lateral surface on a binding position side of the third bound sheet bundle is located at the alignment position or further inward than the alignment position, and subsequently shift the fourth bound sheet bundle such that a lateral surface on a binding position side of the fourth bound sheet bundle is located further inward than the lateral surface of the third bound sheet bundle.

3. The postprocessing apparatus of claim 2, wherein:

the bound sheet bundles further include a third fifth bound sheet bundle and a sixth bound sheet bundle; and the postprocessing controller is configured to control the shift actuator assembly to:

shift the fifth bound sheet bundle such that a lateral surface on a binding position side of the fifth bound sheet bundle is located at the alignment position, and shift the sixth bound sheet bundle such that a lateral surface on a binding position side of the sixth bound sheet bundle is located further inward than the alignment position.

4. The postprocessing apparatus of claim 1, wherein the shift actuator assembly includes the horizontal alignment plate and is configured to shift the bound sheet bundles by moving the horizontal alignment plate to press a lateral surface on a binding position side of each bound sheet bundle while the bound sheet bundles are discharged onto the tray.

5. The postprocessing apparatus of claim 4, wherein the shift actuator assembly includes:

a retention claw positioned to limit upstream movement of the bound sheet bundles in a sheet conveyance direction; and a retention claw actuator controllable to move the retention claw downstream in the sheet conveyance direction to discharge the bound sheet bundles onto the tray.

6. The postprocessing apparatus of claim 4, wherein:

the horizontal alignment plate is a first horizontal alignment plate, and the shift actuator assembly includes a second horizontal alignment plate that is offset from the first horizontal alignment plate by an offset distance in the sheet width direction; and the postprocessing controller is configured to control the shift actuator assembly to set the offset distance while the bound sheet bundles are discharged based on a sheet width of each bound sheet bundle.

7. The postprocessing apparatus of claim 6, wherein the postprocessing controller is configured to control the shift actuator assembly to shift the bound sheet bundles when the offset distance is set to be greater than the sheet width of each bound sheet bundle.

8. A method of performing postprocessing comprising:

receiving a plurality of first sheets between a first horizontal alignment plate and a second horizontal alignment plate;

binding, by a binder, the first sheets to form a first bound sheet bundle;

discharging the first bound sheet bundle onto a tray in a first position in a sheet width direction;

receiving a plurality of second sheets between the first horizontal alignment plate and the second horizontal alignment plate;

binding, by the binder, the second sheets to form a second bound sheet bundle;

discharging the second bound sheet bundle onto the tray to form a stack of bound sheet bundles;

shifting, by a shift actuator assembly, the second bound sheet bundle inward in the sheet width direction such that the second bound sheet bundle is discharged in a second position that is located further inward than the first position;

receiving a plurality of third sheets between the first horizontal alignment plate and the second horizontal alignment plate;

binding, by the binder, the third sheets to form a third bound sheet bundle;

discharging the third bound sheet bundle onto the tray; and in response to a determination that the stack of bound sheet bundles has exceeded a threshold height, shifting, by the shift actuator assembly, the third bound sheet bundle inward in the sheet width direction such that the third bound sheet bundle is discharged in a third position that is located further inward than the first position and the second position.

9. The method of claim 8, further comprising:

receiving a plurality of fourth sheets between the first horizontal alignment plate and the second horizontal alignment plate;

binding, by the binder, the fourth sheets to form a fourth bound sheet bundle; and discharging the fourth bound sheet bundle onto the tray in a fourth position that is located further inward than the third position.

10. The method of claim 8, further comprising:

receiving a plurality of fourth sheets between the first horizontal alignment plate and the second horizontal alignment plate;

binding, by the binder, the fourth sheets to form a fourth bound sheet bundle; and discharging the fourth bound sheet bundle onto the tray in the first a fourth position such that the second bound sheet bundle is positioned on the tray between the first bound sheet bundle and the fourth bound sheet bundle.

11. The method of claim 8, wherein shifting, by the shift actuator assembly, the second bound sheet bundle inward in the sheet width direction includes moving the first horizontal alignment plate inward in the sheet width direction such that the first horizontal alignment plate presses the second bound sheet bundle inward in the sheet width direction.

12. A method of performing postprocessing comprising:

receiving a plurality of first sheets between a first horizontal alignment plate and a second horizontal alignment plate;

binding, by a binder, the first sheets to form a first bound sheet bundle;

discharging the first bound sheet bundle onto a tray in a first position in a sheet width direction;

receiving a plurality of second sheets between the first horizontal alignment plate and the second horizontal alignment plate;

binding, by the binder, the second sheets to form a second bound sheet bundle;

discharging the second bound sheet bundle onto the tray to form a stack of bound sheet bundles;

shifting, by a shift actuator assembly, the second bound sheet bundle in the sheet width direction such that the second bound sheet bundle is discharged in a second position that is offset from the first position;

receiving a plurality of third sheets between the first horizontal alignment plate and the second horizontal alignment plate;

binding, by the binder, the third sheets to form a third bound sheet bundle; and discharging the third bound sheet bundle onto the tray in a third position such that the second bound sheet bundle is positioned on the tray between the first bound sheet bundle and the third bound sheet bundle;

receiving a plurality of fourth sheets between the first horizontal alignment plate and the second horizontal alignment plate;

binding, by the binder, the fourth sheets to form a fourth bound sheet bundle;

discharging the fourth bound sheet bundle onto the tray; and in response to a determination that the stack of bound sheet bundles has exceeded a threshold height, shifting, by the shift actuator assembly, the fourth bound sheet bundle inward in the sheet width direction such that the fourth bound sheet bundle is discharged in a fourth position that is located further inward than the first position and the second position.

13. The method of claim 12, wherein shifting, by the shift actuator assembly, the second bound sheet bundle in the sheet width direction includes moving the first horizontal alignment plate in the sheet width direction such that the first horizontal alignment plate presses the second bound sheet bundle in the sheet width direction.

* * * * *